United States Patent [19]

Krummacher et al.

[11] Patent Number: 4,559,870

[45] Date of Patent: Dec. 24, 1985

[54] SYSTEM FOR THE TREATMENT OF WASTE PRODUCTS

[76] Inventors: Martin W. Krummacher, 3330 NE. Alberta Ct., Portland, Oreg. 97211; Lavon A. Harmon, 7026 N. Campbell Ave., Portland, Oreg. 97217; Perry E. Clipfell, 427 W. Regis St., Stayton, Oreg. 97383

[21] Appl. No.: 530,089

[22] Filed: Sep. 7, 1983

[51] Int. Cl.[4] ..... B30B 15/30

[52] U.S. Cl. ..... 100/215; 100/229 A; 100/255; 53/436; 206/527

[58] Field of Search ..... 100/215, 255, 229 A, 100/70 R; 141/73, 80; 53/436; 206/527

[56] References Cited

U.S. PATENT DOCUMENTS

| | | | |
|---|---|---|---|
| 3,731,616 | 5/1973 | Ligh | 100/229 A X |
| 3,756,143 | 9/1973 | Hennells | 100/255 X |
| 3,831,514 | 8/1974 | Jernstrom | 100/70 R |
| 4,008,658 | 2/1977 | Stock | 100/229 R |
| 4,022,123 | 5/1977 | Bachmann | 100/255 X |
| 4,152,035 | 5/1979 | Fox | 100/229 A |
| 4,232,599 | 11/1980 | Ulrich | 100/255 X |

*Primary Examiner*—Billy J. Wilhite

*Attorney, Agent, or Firm*—Chernoff, Vilhauer, McClung, Birdwell & Stenzel

[57] ABSTRACT

An integrated system for the treatment of waste products such as domestic, industrial, or commercial trash comprises the placement of waste in barrel-shaped, self-supporting containers, compaction of the waste in the containers in an especially adapted waste compactor, and the fitting of covers to the containers to provide sealed readily transportable and disposable packages of compacted waste.

6 Claims, 7 Drawing Figures

SYSTEM FOR THE TREATMENT OF WASTE PRODUCTS

BACKGROUND OF THE INVENTION

The invention relates to an integrated system for the treatment of waste products, such as domestic, commercial, or industrial trash and the like, and embodies a method of waste tretment, apparatus adapted for use therein, and a novel readily disposable waste package resulting therefrom.

More particularly the invention involves the compaction of waste products in barrel-like containers, in an especially adapted waste compactor to produce disposable packages of compacted waste. The containers may, for example, comprise disposable bio-degradable barrels of fibrous material, of the type disclosed in applicants' co-pending U.S. patent application No. 530,088 entitled "Collapsible Barrel Structure".

DESCRIPTION OF THE PRIOR ART

Applicants are aware of the following U.S. patents relating to waste compactors:

U.S. Pat. No. 3,731,616, May 5, 1973;
U.S. Pat. No. 4,022,123, May 10, 1977;
U.S. Pat. No. 4,232,599, Nov. 11, 1980;

SUMMARY OF THE INVENTION

The invention is based on the novel concept of compacting waste into self-supporting, barrel-like containers of sufficient strength and rigidity to retain the compacted waste for transportation and disposal. The containers may, for example, comprise conventional steel drums, or alternatively may comprise disposable biodegradable barrels of cardboard or like fibrous materials, as disclosed in the aforementioned, co-pending patent application. When suitably filled with compacted waste, the barrels may be suitably sealed, for example, with a fitted cover, thereby producing readily transportable and disposable waste packages.

A waste compactor in accordance with the invention for use in the integrated waste treatment system may comprise, for example, a stationary frame having a cooperating pivotal door, the frame and door together defining a substantially cylindrical compacting chamber when the door is closed, a fluid-pressure-operated ram with a vertically reciprocal platen mounted on the frame above said chamber for compacting waste in a barrel located in the chamber, and a barrel-support anvil associated with the door on which a barrel may be positioned for movement into and out of the compacting chamber.

Additional features of the apparatus aspect of the invention include, for example, the provision of an auxiliary load opening associated with the compactor frame allowing waste to be fed into a barrel in the compacting chamber without having to open the main compactor door, the provision of a germicidal lamp within the compacting chamber for minimizing bacterial growth in the waste products contained therein, and a barrel protector ring having aligning segments on the interior of the door and frame to avoid damage to a barrel from the descending platen during waste compaction.

The inventive system of waste disposal is considered superior to traditional systems in which waste is compacted in collapsible bags and the like. The use of self-supporting containers, for example, allows for a greater degree of compaction without bursting of the container both during compaction and subsequently during shipment. The inventive system is thus suited to diverse waste disposal applications including, for example, use by hospitals, schools, recyclers, or fast-food chains.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
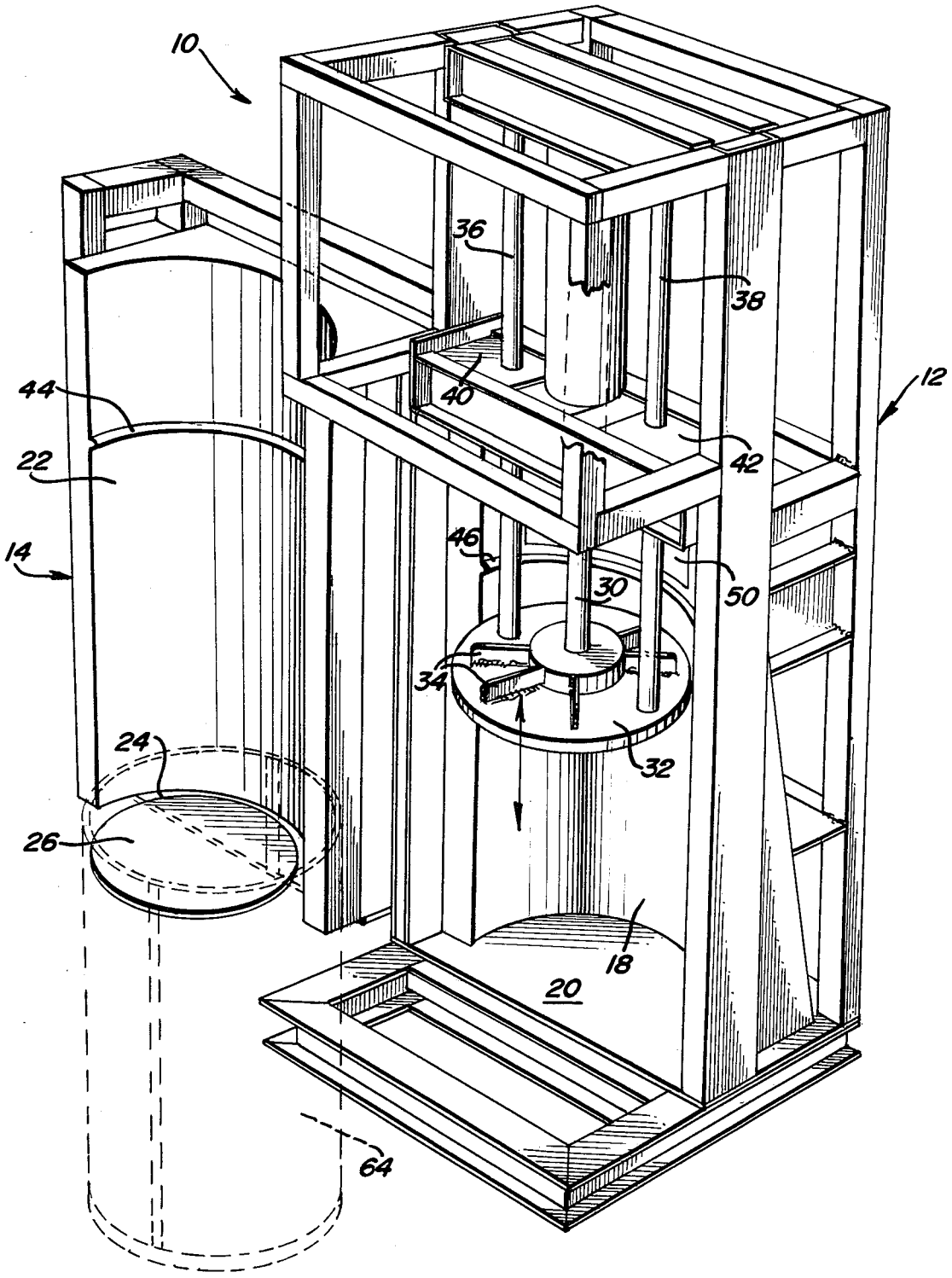
FIG. 1 is a perspective view of a waste compactor in accordance with the invention showing skeletal details of the compactor framework with the covering panels removed.
Figure 2:
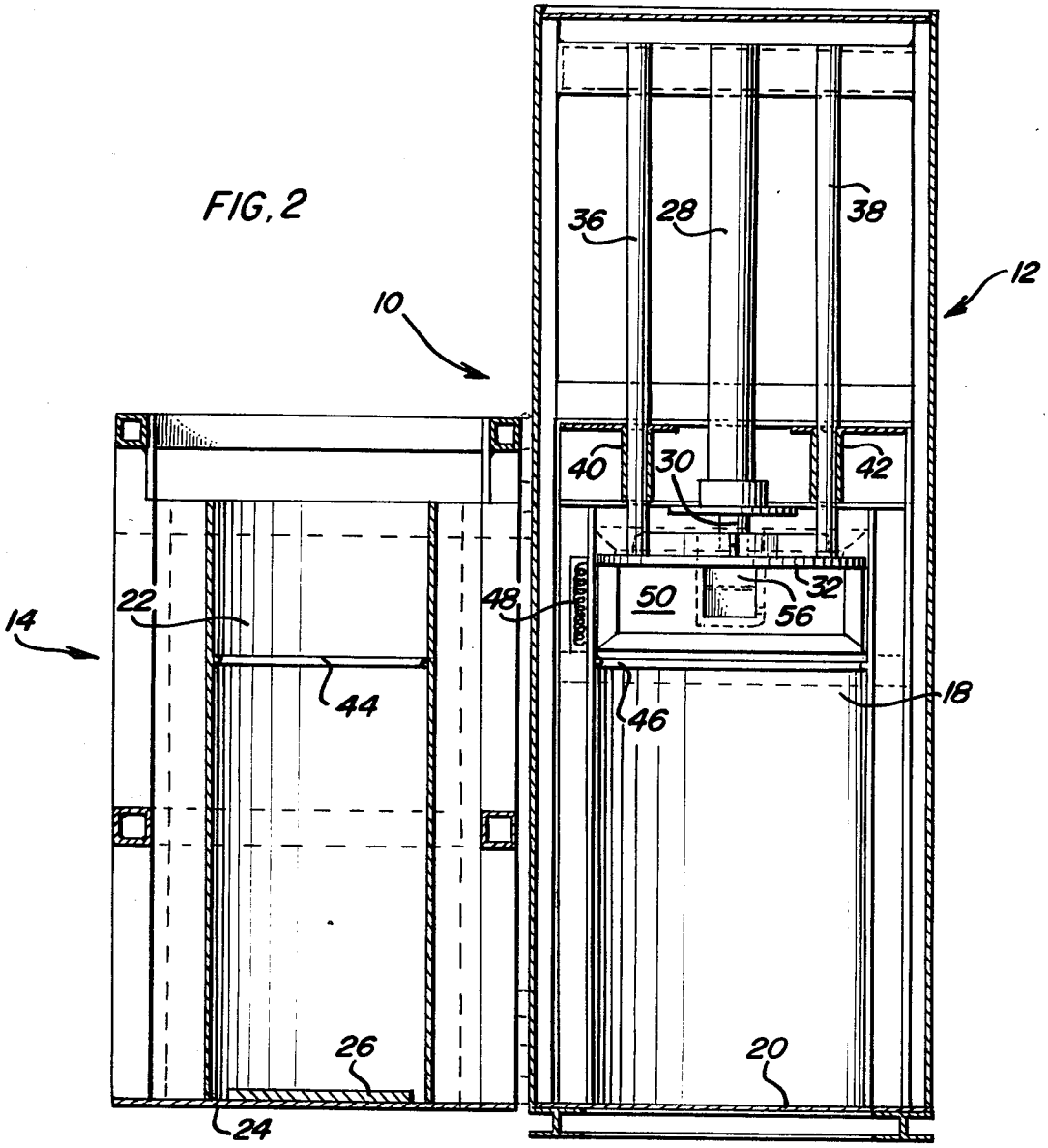
FIG. 2 is a front elevational view of the compactor as shown in FIG. 1.
Figure 5:
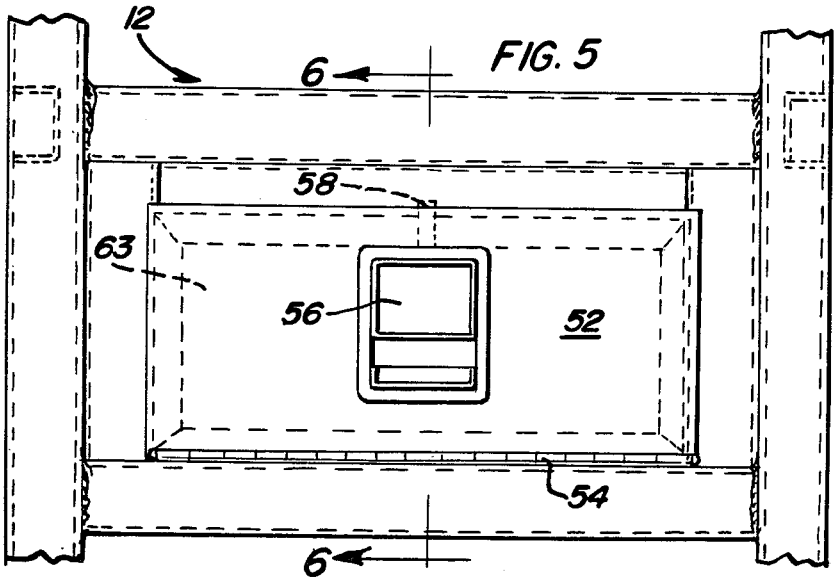
FIG. 5 is a detailed rear elevational view, to an enlarged scale, of a part of the compactor structure, notably an auxiliary loading chute.
Figure 6:
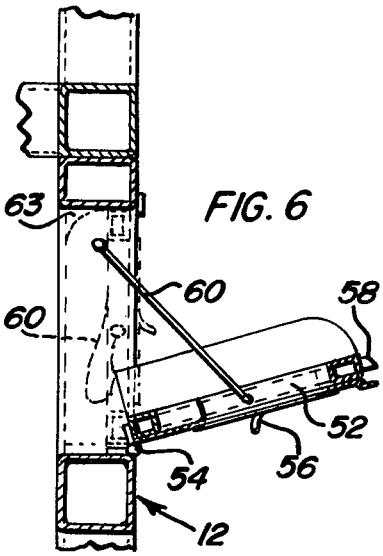
FIG. 6 is a sectional view on line 6—6 of FIG. 5.
Figure 3:
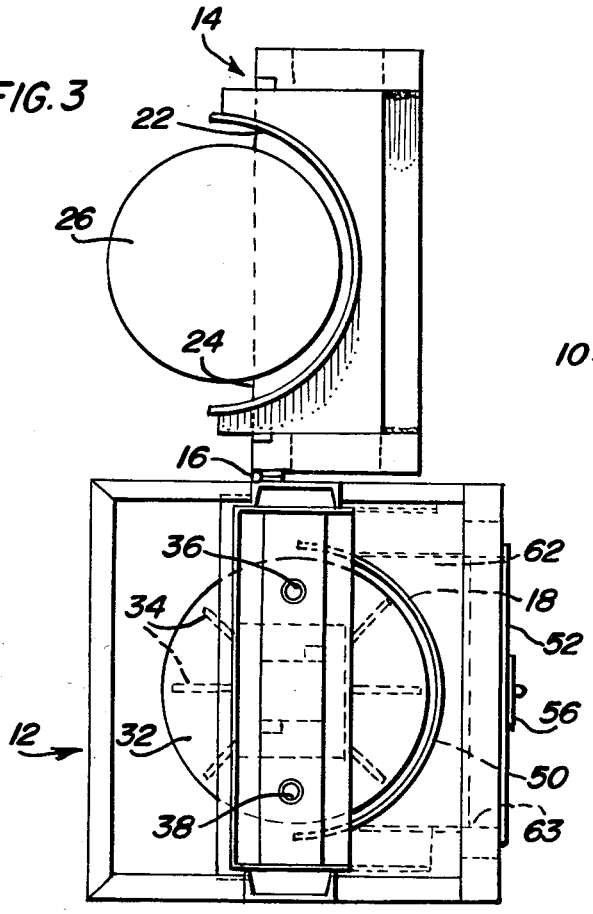
FIG. 3 is a plan view of the compactor.
Figure 4:
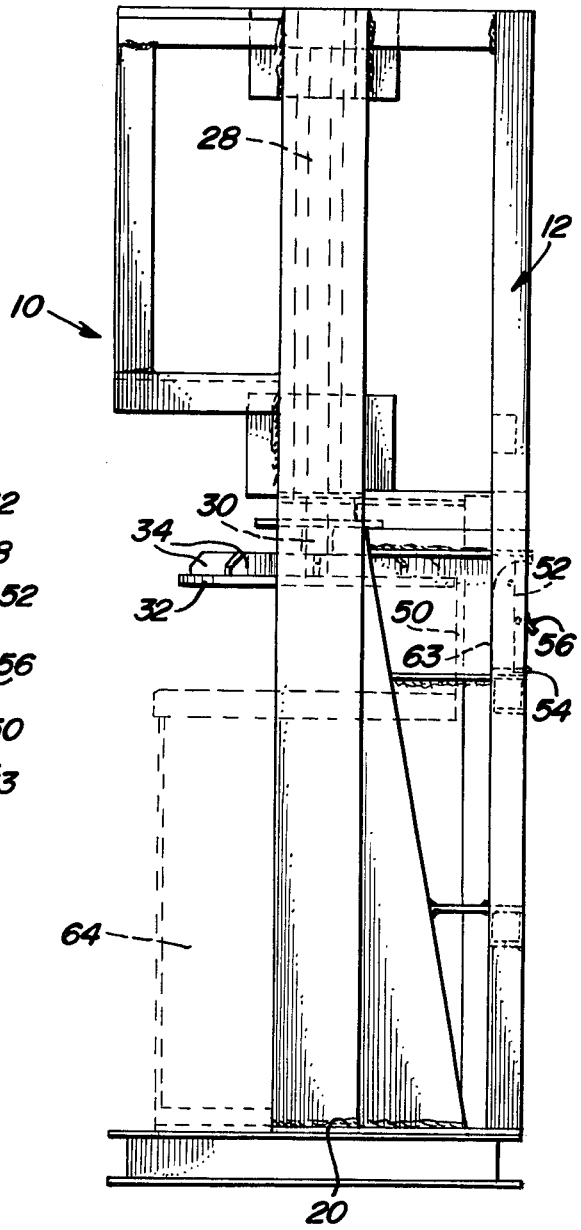
FIG. 4 is a side elevational view of the compactor.

Referring initially to FIGS. 1–6, there is illustrated a waste compactor 10 having a main frame portion 12, and a door 14 pivoted to the main frame by suitable hinges 16 (see FIG. 3).

The main frame portion includes a semi-cylindrical interior wall 18, and a base wall 20, while door 14 has a semi-cylindrical interior wall 22 complementary to wall 18, and a base wall 24 which is attached (by welding or the like) a circular anvil 26. The door is shown in the open position, but it will be understood that when the door is closed, anvil 26 is received on base wall 20 while walls 18 and 22 are connected to define a cylindrical compacting chamber. A suitable locking handle and latch mechanism (not shown) may be provided for releasably latching the door and frame is closed position.

Above the compacting chamber, the main frame portion 12 supports a vertically oriented hydraulic ram structure including a ram cylinder 28 having a piston rod 30 to the end of which is secured a circular platen 32 with reinforcing ribs 34. The diameter of the platen is adapted to the diameter of the compacting chamber and the stroke of the ram is preferably sufficient for the platen to reach substantially to the base of the compacting chamber. (Pressure controls may be provided for the ram to automatically move the platen to required levels during compaction of a container as the container is progressively filled with compacted waste.) The platen also has associated guide rods 36, 38 received in guides 40, 42 in the frame.

Wall 22 of door 24 includes a projecting barrel protector ring segment 44 at a height above anvil 26 sufficient to accommodate a barrel of specified height therebelow, and wall 18 has a complementary protector ring segment 46. When the door is closed, the protector ring segments come together to form a peripheral protector ring for protecting the rim of a barrel in the compacting chamber from the descending platen.

The dimensions of the compacting chamber may, for example, be adapted to accommodate below the protector ring a standard 55-gal. steel drum, or an alternative barrel which may be of the type disclosed in the aforementioned co-pending patent application.

Above the barrel protector ring segment 46, and recessed into wall 18 is a germicidal lamp 48 (see FIG. 2) and also above ring segment 46 wall 18 is provided with an auxiliary waste-receiving opening 50 communicating with a pivotal chute 52 attached to the rear of frame 12 by hinge 54. The chute has a pivotal-type operating lever 56 and latch 58, and stays 60. Suitably profiled gusset plates 62 connect curved opening 50 in wall 18 with the planar opening 63 receiving the pivotal chute 52. Opening 50 and chute 52 provide access to the top of the compacting chamber without having to open the main door 14.

In use, a barrel 64 which may be a steel drum, or a bio-degradable fibrous barrel as previously noted, is placed on anvil 26 and filled with waste to be compacted. Door 14 is latched closed and the ram 28 is set in motion causing platen 32 to compact the waste in the barrel. (Suitable electrical and hydraulic controls, not shown, are incorporated in the compactor and may, for example, be housed in compartments above the compacting chamber.) After compaction of the initial charge of waste in the barrel, door 14 may be opened to remove the barrel from the frame and allow an additional charge of waste to be placed in the barrel, so that the compacting process may be repeated. Alternatively, in order to avoid having to open the main door, small waste items can be inserted progressively into the compacting chamber for receipt in the top of the barrel through chute 52 and opening 50. During its stay in the compacting chamber, the barrel is protected from the platen by the barrel protector ring, and operation of the germicidal lamp reduces bacterial growth in the compacted waste while this remains in the chamber.

When a barrel has been suitably filled with compacted waste, it may be removed by opening door 14 and the barrel may then be sealed, for example, by fitting a cover to the barrel. In the case of fibrous collapsible barrels of the type referred to in the above co-pending application, for example, a cover 66 may be pressed under an internal barrel flange 68 (see FIG. 7) to provide suitable sealed retention of the cover. Thus, fitting of the cover to a barrel could be accomplised in the compactor chamber by use of the platen. Flange 68 may be formed by a fold in the collapsible cylindrical body portion of the barrel, and a suitable fold defines a flange 70 supporting a removable barrel base 72. Alternatively, the barrel flanges may be formed by rings fitted to the ends of the body portion. For a fuller description of collapsible barrels of this nature, reference is made to the co-pending application, the disclosure of which is included herein by reference.

Figure 7:
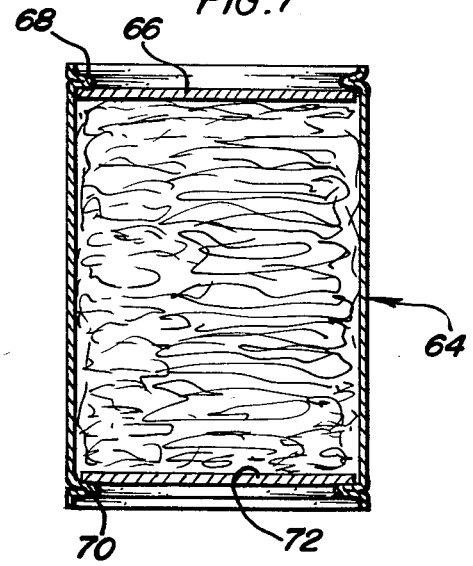
FIG. 7 is a vertical sectional view of a compacted waste package in accordance with the invention.

A filled barrel is shown in FIG. 7, and forms a readily transportable and disposal waste package. The invention lends itself to the efficient disposal and compaction of various forms of waste. For example, it is been found that a bio-degradable disposable barrel of the type described and having the capacity of a 55-gal. drum can receive about 9 cubic yards of compacted waste of the general type received from a fast-food restaurant and consisting essentially of paper, boxes, plastic containers and the like. Further, since a container may be closed before it is removed from the compactor, air supply to the compacted waste is minimized which also impedes bacterial growth and minimizes odors. The closed containers are of minimal attraction to rodents and storage time prior to transportation can be increased. This factor allows less frequent pickups and more economical handling of waste.

Use of steel drums as the containers in the inventive system, allow the system to be applied to the compaction of glass or steel lathe turnings and the like. Brass and aluminum lathe turnings and aluminum cans are preferably compacted in the bio-degradable-type barrels. This allows the entire container and its contents to be placed into a furnace for melting the metal. Since there is no metal in the barrel itself, the barrel will burn away without contaminating the brass or aluminum in any way. By compaction of metals in this manner, a better percentage of recovery is maintained.

As previously noted, the main door of the compactor may be used to receive full bags or large amounts of waste, while the auxiliary chute 50 may be used for smaller amounts of waste. When the compactor is to be used in an application such as a domestic apartment complex, where drop chutes are used, a stuffer unit may be attached to the compactor.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A waste compactor comprising a stationary frame having a cooperating pivotal door, the frame and door together defining a uniformly cylindrical compacting chamber when the door is closed, a reciprocatory compaction ram with a vertically reciprocable platen mounted on the frame above said chamber, a barrel support anvil associated with the door on which a barrel may be positioned for movement into and out of the compacting chamber, a horizontally protruding barrel protector ring segment on an internal compactor chamber-defining wall of the door and a complementary horizontally protruding barrel protector ring segment on an internal chamber-defining wall of the frame, said segments cooperating to define a barrel protector ring around the interior of the chamber when the door is closed adapted to fit above the rim of a barrel in the chamber and protect the rim against damage by the platen, said barrel protector ring protruding horizontally into the interior of said chamber.

2. The invention of claim 1 including a germicidal lamp located in a wall portion of the frame defining the compacting chamber and situated at a level above the rim of a barrel located in the chamber.

3. The invention of claim 1 including an opening in a semicylindrical wall portion of the frame defining the compacting chamber, the opening being located at a level above the rim of a barrel located in the chamber, and a pivotally mounted chute associated with a planar portion of the frame for obtaining access to the opening, whereby waste products may be inserted into a barrel when the door is closed.

4. A waste compactor comprising a stationary frame having a cooperating pivotal door, the frame having a part-cylindrical wall and the door having a cooperating part-cylindrical wall, said walls together defining a substantially cylindrical compacting chamber when the door is closed, a reciprocatory compaction ram with a vertically reciprocal platen mounted on the frame above said chamber, a barrel support anvil associated with the door on which a barrel may be positioned for movement into and out of the compacting chamber, an opening in the part-cylindrical wall of the frame at a level above the rim of a barrel located in the chamber, the frame having a planar portion behind said opening, a further opening in the planar portion, and profiled gussets connecting said openings so as to provide insertion means for waste products into the compacting chamber when the door is closed.

5. The invention of claim 4 including a chute pivotally mounted on the planar portion of the frame for selectively opening and closing the further opening.

6. A waste compactor comprising:

(a) a stationary frame having a cooperating pivotal door, the frame and door together defining a cylindrical compacting chamber when the door is closed;

(b) a reciprocatory compaction ram with a vertically reciprocable platen mounted on the frame above said chamber;

(c) a barrel support anvil associated with the door on which a barrel may be positioned for movement into and out of the compaction chamber;

(d) a barrel protector ring segment on an internal compactor chamber-defining wall of the door and a complementary barrel protector ring segment on an internal chamber-defining wall of the frame, said segments cooperating to define a barrel protector ring around the interior of the compacting chamber when the door is closed and adapted to fit above the rim of a barrel in the compacting chamber and protect said barrel rim against damage by the platen;

(e) a wall opening in a semicylindrical wall portion of the frame defining the compacting chamber, said wall opening being located at a level above the rim of the barrel located in the chamber;

(f) a chute opening formed in a planar portion of the frame behind said wall opening, said chute opening having associated therewith a pivotally mounted chute; and (g) profiled gussets connecting said wall opening and said chute opening.

* * * * *

UNITED STATES PATENT AND TRADEMARK OFFICE

CERTIFICATE OF CORRECTION

PATENT NO. : 4,559,870

DATED : Dec. 24, 1985

INVENTOR(S) : Martin W. Krummacher, et al.

It is certified that error appears in the above-identified patent and that said Letters Patent is hereby corrected as shown below:

| | | |
|---|---|---|
| Col. 1, Line 9, | Change "tretment" to --treatment-- |
| Col. 2, Line 39, | After "24" insert --to-- |
| Col. 2, Line 46 | Change "is" to --in-- |

Signed and Sealed this

*Sixteenth* Day of *September 1986*

[SEAL]

*Attest:*

DONALD J. QUIGG

*Attesting Officer*

*Commissioner of Patents and Trademarks*